US011098476B2

(12) United States Patent
Jin et al.

(10) Patent No.: US 11,098,476 B2
(45) Date of Patent: Aug. 24, 2021

(54) CONNECTING CORE FOR COLUMN-BEAM JOINT AND CONNECTION METHOD USING THE SAME

(71) Applicant: GAURIAN CORPORATION, Goyang-si (KR)

(72) Inventors: Joo Ho Jin, Paju-si (KR); Koo Yun Park, Seoul (KR); Hyun Sook Kim, Goyang-si (KR); Dong Joon Kim, Goyang-si (KR); Doo Hwan Kim, Goyang-si (KR)

(73) Assignee: GAURIAN CORPORATION, Gyeonggi-Do (KR)

( * ) Notice: Subject to any disclaimer, the term of this patent is extended or adjusted under 35 U.S.C. 154(b) by 600 days.

(21) Appl. No.: 16/073,571

(22) PCT Filed: Mar. 26, 2018

(86) PCT No.: PCT/KR2018/003533
§ 371 (c)(1),
(2) Date: Jul. 27, 2018

(87) PCT Pub. No.: WO2019/059480
PCT Pub. Date: Mar. 28, 2019

(65) Prior Publication Data

US 2021/0207358 A1 Jul. 8, 2021

(30) Foreign Application Priority Data

Sep. 22, 2017 (KR) ..... 10-2017-0122432

(51) Int. Cl.
*E04B 1/24* (2006.01)
*E04H 9/02* (2006.01)

(52) U.S. Cl.
CPC ..... *E04B 1/2403* (2013.01); *E04H 9/024* (2013.01); *E04B 2001/2415* (2013.01); *E04B 2001/2418* (2013.01); *E04B 2001/2454* (2013.01)

(58) Field of Classification Search
CPC ..... E04B 1/2403; E04B 2001/2415; E04B 2001/2454; E04B 2001/2418; E04H 9/024
See application file for complete search history.

(56) References Cited

U.S. PATENT DOCUMENTS 1,581,487 A * 4/1926 Gustavus ..... E04B 1/2403 52/653.2
2,720,291 A * 10/1955 Larkin ..... E04B 1/2403 403/169

(Continued)

FOREIGN PATENT DOCUMENTS

CN 106088334 A 11/2016
CN 106836483 A 6/2017

(Continued)

OTHER PUBLICATIONS

International Search Report issued in PCT/KR2018/003533 (in Korean), dated Jul. 2, 2018; ISA/KR.

*Primary Examiner* — Rodney Mintz
(74) *Attorney, Agent, or Firm* — Lex IP Meister, PLLC

(57) ABSTRACT

The present disclosure relates to a connecting core for column-beam joint, the connecting core being able to secure excellent rigidity through a simple process without welding. To this end, a connecting core for column-beam joint includes: a closed-section intermediate column; a diaphragm; and internal reinforcing members, in which slit for inserting the internal reinforcing members are formed at the diaphragm, and the internal reinforcing members inserted in the diaphragm are combined with the intermediate column. According to the present disclosure, high rigidity is secured, (Continued)

as compared with the related art, when a closed-section column and a beam are connected. Further, a closed-section column and a beam can be connected without welding, so the process can be shortened, connecting become easy, and quality is also uniform.

14 Claims, 21 Drawing Sheets

(56) References Cited

U.S. PATENT DOCUMENTS 3,110,982 A * 11/1963 Besinger ..... E04B 1/185 52/301
3,393,483 A * 7/1968 Naillon ..... E04B 1/2403 52/263
3,594,971 A * 7/1971 Hughes ..... E04B 1/215 52/648.1
3,783,565 A * 1/1974 Hughes ..... E04B 1/215 52/127.1
3,822,519 A * 7/1974 Antoniou ..... E04B 1/3483 52/79.13
3,977,801 A * 8/1976 Murphy ..... E04B 1/2403 248/188
4,069,626 A * 1/1978 Schuette ..... E04B 7/18 52/462
4,173,853 A * 11/1979 Logan ..... E04H 12/00 52/301
4,435,927 A * 3/1984 Umezu ..... E04B 1/3483 52/235
4,723,384 A * 2/1988 Mengeringhausen .... E04B 1/24 52/126.1
4,905,444 A * 3/1990 Semaan ..... E04B 1/4107 52/235
6,219,989 B1 * 4/2001 Tumura ..... E04B 1/2403 52/274
7,028,435 B2 * 4/2006 Walker ..... E04B 1/24 52/236.5
7,637,076 B2 * 12/2009 Vaughn ..... F16B 9/058 52/838
8,468,775 B2 * 6/2013 Vaughn ..... E04B 1/24 52/843
9,249,593 B2 * 2/2016 Perko ..... E04H 9/145
10,167,623 B2 * 1/2019 Mou ..... E04B 1/2403
10,179,991 B2 * 1/2019 Houghton ..... E04B 1/2403
10,260,225 B2 * 4/2019 Lee ..... E04B 1/043
10,508,432 B2 * 12/2019 Theriot ..... E04B 1/2403
10,626,594 B2 * 4/2020 Yu ..... E04B 1/5812
10,633,851 B2 * 4/2020 Mou ..... E04B 1/21
10,851,537 B2 * 12/2020 Zhang ..... E04B 1/2403
10,961,696 B2 * 3/2021 Mou ..... G01M 5/0083
2005/0097854 A1 * 5/2005 Tu ..... E04C 3/04 52/698
2006/0265992 A1 * 11/2006 Hiragaki ..... E04B 5/43 52/633
2007/0209314 A1 * 9/2007 Vaughn ..... E02D 27/34 52/838
2007/0261356 A1 * 11/2007 Vaughn ..... F16B 9/01 52/655.1
2015/0315788 A1 11/2015 Vanker et al.
2017/0233995 A1 * 8/2017 Abernathy ..... F16B 7/182 52/845
2017/0233996 A1 * 8/2017 Abernathy ..... F16B 7/0446 52/698
2017/0356177 A1 * 12/2017 Lee ..... E04B 1/215
2018/0094419 A1 * 4/2018 Houghton ..... E04B 1/2403
2018/0094420 A1 * 4/2018 Houghton ..... E04B 1/2403
2018/0187407 A1 * 7/2018 Mou ..... E04B 1/2403
2018/0245329 A1 * 8/2018 Yu ..... E04B 1/2403
2019/0271144 A1 * 9/2019 Zhang ..... E04B 1/185
2019/0323223 A1 * 10/2019 Theriot ..... E04C 3/32
2019/0338506 A1 * 11/2019 Mori ..... E04H 12/2261
2019/0376273 A1 * 12/2019 Mou ..... E04H 9/024
2021/0047825 A1 * 2/2021 Mou ..... G01M 5/0083

FOREIGN PATENT DOCUMENTS

JP 1975-026163 8/1975
JP H05-022705 U 3/1993
JP 2002-266426 A 9/2002
JP P2006-132144 5/2006
JP 2006-342526 A 12/2006
JP 2006342526 A * 12/2006
JP 4047873 B2 2/2008
JP 2013-167133 A 8/2013
KR 10-1368311 B1 2/2014

* cited by examiner (b)

(a)

CONNECTING CORE FOR COLUMN-BEAM JOINT AND CONNECTION METHOD USING THE SAME

CROSS-REFERENCE TO RELATED APPLICATION

This application is a U.S. National Phase Application under 35 U.S.C. 371 of International Application No. PCT/KR2018/003533 filed on Mar. 26, 2018. This application claims priority from and the benefit under 35 U.S.C. § 119(a) of Korean Patent Application No. 10-2017-0122432, filed on Sep. 22, 2017. The disclosures of both of the above applications are hereby incorporated by reference for all purposes as if fully set forth herein. Also, when this application claims the priority benefit of the same Korean Patent Applications from countries in addition to the U.S., the disclosure will be incorporated herein by reference.

TECHNICAL FIELD

The present disclosure relates to a connecting core for a column-beam joint and, more particularly, to a connecting core for a column-beam joint, the connecting core being able to easily assemble a column and a beam with a yield strength even without welding when connecting the column and the beam, as compared with the related art, and a connection method using the same.

BACKGROUND ART

Many columns and beams are needed to construct a building. In general, columns and beams are made of metal. For example, columns may be hollow rectangular metal pipes and beams may be H-beams.

Frames of a building can be formed by connecting such columns and beams and then the building can be constructed using the frames.

Since many columns and beams are used and should be connected to construct a building, as described above, various technologies about connecting cores for connecting them have been known.

In those technologies, local buckling occurs at the joints of columns and beams, so frameworks slightly absorb energy and then brittle failure occurs at the joints in some cases. In particular, it was found from damage cases by earthquakes in the past that failure occurred at joints and brittle failure occurred at joints after local buckling.

In particular, in a steel moment-resisting frame, column flanges-beam flanges are welded in factories for moment connection, so a method other than welding should be considered.

H-beam columns having a web and flanges are simply connected because it is an open-section type, but closed-section steel tube columns are difficult to connect due to the shape characteristic of the closed-section, so it is difficult to secure strength and rigidity.

In connection methods that are currently used in consideration of this problem, a method of reinforcing a joint by preventing deformation of column surfaces, withstanding bending load by a beam, and allowing for moment connection with a beam, using a reinforcing member such as a diaphragm is widely used.

There are many type of diaphragms such as a through type diaphragm, an internal type diaphragm, and an external type diaphragm. The through type diaphragm and the internal type diaphragm are formed by cutting a steel tube column and then passing a diaphragm through a beam flange position or welding again a diaphragm in steel tube. This type provides a simple external appearance, but requires highly skilled technique in welding and there is large difficulty in quality management for welding testing. The external type diaphragm is formed by attaching and welding a diaphragm having inclination to the outer side of a steel tube. In this case, welding is easy, but a relatively large amount of steel materials is used, it takes a large cost to manufacture and machine a diaphragm, and the external appearance of the surrounding portion of a joint is also complicated.

Above all, in the method using diaphragms in the related art, many processes up to sixteen are required and welding is necessary.

Accordingly, there is a need for a connecting core that can maintain excellent rigidity with a simple method.

On the other hand, in column-beam connection in the related art, beams are connected by installing brackets to be able to construct two to three floors on columns. In this case, two methods of connecting columns and connecting a column and a beam are both used. However, when two to three stories of columns are installed at one time and then beams are installed, workers may be endangered due to high-place working.

A Concrete-Filled Steel Tube (CTF), which is a closed-section steel tube, is a structural system that is excellent in strength and energy absorption ability because a steel tube for resisting bending moment is disposed outside and concrete for resisting axial force is disposed inside, whereby the steel tube retains the internal concrete, and the concrete prevents local buckling of the steel tube.

The CFT structure, which is a structure including a closed-type steel tube column filled with concrete, is stable in structure in terms of rigidity, yield strength, and deformation and is excellent in terms of fire resistance and construction. The CFT structure has to be produced by applying specific welding to a steel tube that is the material thereof in a large factory having specific manufacturing facilities, so manufacturing costs are too high and applicability of the CFT structure is limited by the economic problem. In spite of the actual advantages of structural stability and easy construction of the CFT structure, real-world implementation thereof has been limited to date.

DETAILED DESCRIPTION OF THE DISCLOSURE

Technical Problem

An aspect of the present disclosure is to provide a connecting core for connecting a closed-section steel tube column and a beam, thereby being able to secure excellent rigidity even through a simple process, unlike the related art, and a method of connecting a column and a beam using the connecting core.

Another aspect of the present disclosure is to provide a connecting core that can connect a closed-section steel tube column and a beam even without welding, and a method of connecting a column and a beam using the connecting core.

Another aspect of the present disclosure is to provide a method of connecting a column and a beam, the method being able to increase buckling strength by inserting bolts even in a closed-section steel tube and to improve the adhesive force between concrete and a closed-section steel tube, as compared with existing CFT columns.

Another aspect of the present disclosure is to provide a connecting core that can provide an assembly type closed-section steel frame member that can increase the force retaining concrete in a concrete-filled column.

Technical Solution

The present disclosure provides a connecting core having the following configuration.

A connecting core for column-beam joint includes:

a closed-section intermediate column;

a diaphragm; and internal reinforcing members, in which slit for inserting the internal reinforcing members are formed at the diaphragm, and the internal reinforcing members inserted in the diaphragm are combined with the intermediate column.

The internal reinforcing members may be plates and four internal reinforcing members may be provided to be coupled to the inner side of the intermediate column that is a closed-section steel tube. The internal reinforcing members retain a through type diaphragm, thereby preventing bending of column surfaces and making flow of force at joints smooth. Several holes for bolting are formed at the internal reinforcing members.

The diaphragm is a through type diaphragm that is a steel plate and is preferably formed in a rectangular shape. The diaphragm makes flow of force smooth at a joint. A through-hole is preferably formed at the center of the diaphragm.

In a preferred embodiment of the present disclosure, slits for inserting the internal reinforcing members may be formed at the diaphragm.

In another embodiment of the present disclosure, L-shaped slits are formed at corners of the diaphragm, so the internal reinforcing members each may also be formed in an L-shape.

In another embodiment of the present disclosure, two slits may be formed along each side of the diaphragm. In this case, the internal reinforcing members each have two protrusions at each of an upper portion and a lower portion such that two protrusions are fitted in two slits formed along each side of the diaphragm.

Further, it is more preferable that two diaphragms are provided to be coupled to an upper portion and a lower portion of the intermediate column. The lower diaphragm resists compression of a lower flange and the upper diaphragm resists the internal reinforcing members and column surfaces when tension is generated in the upper flange, thereby generating yield strength.

When it is preferable that a stopper is formed at the internal reinforcing members to help determine a vertical position of the diaphragm when the internal reinforcing member is combined with the diaphragm. The stopper is a stepped portion in a preferred embodiment. That is, the stepped portion is formed by changing the width at a longitudinally predetermined position of the internal reinforcing member and the diaphragm is locked to the stopped portion, so the diaphragm cannot be moved any further.

The intermediate column is a closed-section steel tube. The internal reinforcing members are coupled to the inner side of the intermediate column and external reinforcing members are coupled to the outer side of the intermediate column. Several bolt holes are formed for this coupling. The diaphragms are coupled to the upper portion and the lower portion of the intermediate column.

The external reinforcing members that are coupled to the outer side of the intermediate column further increase rigidity of the connecting core. Several holes for bolting are also formed at the external reinforcing members.

Beams that are connected to the connecting core according to the present disclosure are generally H-beams, but are not limited thereto. Stiffeners may be formed for the structural characteristics of beams.

Meanwhile, the present disclosure provides a method of connecting a column and a beam using the connecting core described above and the method includes the following steps:

forming a connecting core by assembling internal reinforcing members, a diaphragm, an intermediate column, and external reinforcing members;

coupling a closed-section lower column to the connecting core;

carrying the assembly of the connecting core and the lower column to a site and then combining a beam with the assembly;

coupling an upper column to the connecting core; and coupling a beam to the connecting core, in which the columns and the beams can be connected without welding.

In this method, only the connecting core is manufactured in advance in a factory and then carried to a site, and then the latter processes may be performed at the site.

The coupling processes can be achieved only by bolts, preferably, one-way bolts that can be tightened only in one direction, so welding is not needed.

Meanwhile, in the present disclosure, the method may further include pouring concrete into the upper column, the lower column, and the intermediate column after the coupling of a beam to the connecting core.

In this case, since concrete is poured in a closed-section steel tube, higher structural performance can be achieved by adhesive force between the concrete and bolts. Further, there is no need for a process that uses a mold to pour concrete into a closed-section steel tube, so the construction period can be shortened.

Advantageous Effects

According to the present disclosure, high rigidity is secured, as compared with the related art, when a closed-section steel tube and a beam are connected. Further, a closed-section tube and a beam can be connected without welding, so the process can be shortened, connecting becomes easy, and quality is uniform.

Further, according to the present disclosure, floors can be constructed one by one by connecting the lower column, the upper column, and the beams at one point using the connecting core. Accordingly, it is possible to work at a low height, so the work can progress very safely, and for a large-area building, the construction period can be shortened through efficient separate construction.

Further, according to the present disclosure, as compared with existing CFTs, buckling resistance is increased and adhesive force between concrete and a closed-section steel tube is improved by bolts inserted in the closed-section steel tube.

Further, according to the present disclosure, it is convenient to pour concrete and construct a building Further, according to the present disclosure, the manufacturing process is simplified because there is no need for welding.

Further, according to the present disclosure, the construction period is shortened because there is no need for rebar placing and molding.

Further, according to the present disclosure, as compared with common RC and SRC structures, an efficient space is increased because the cross-section of a column is reduced, an economic effect can be achieved in buildings requiring column finishing because there is no need for specific finishing.

MODE FOR CARRYING OUT THE DISCLOSURE

Hereafter, the present disclosure is described in detail with reference to the accompanying drawings.

Figure 1:
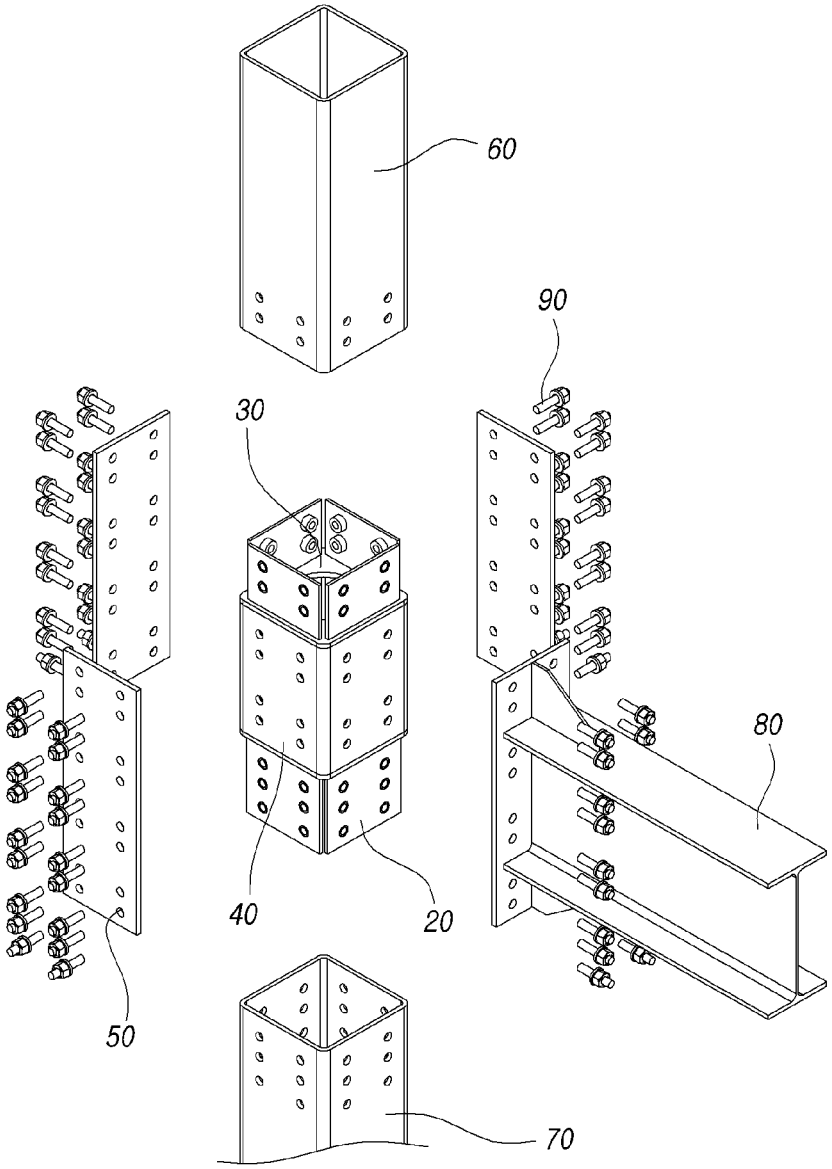
FIG. 1 is an exploded perspective view showing the concept of combining a column and a beam using a connecting core according to a first embodiment of the present disclosure.
Figure 2:
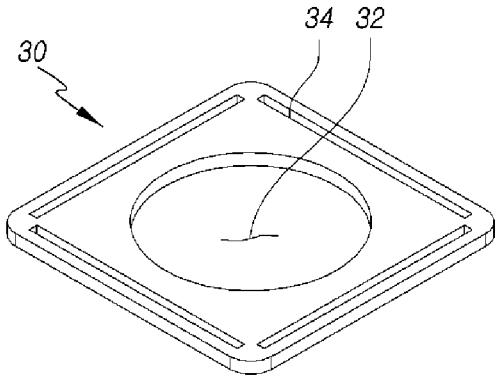
FIG. 2 is a perspective view of a diaphragm according to the first embodiment of the present disclosure.
Figure 3:
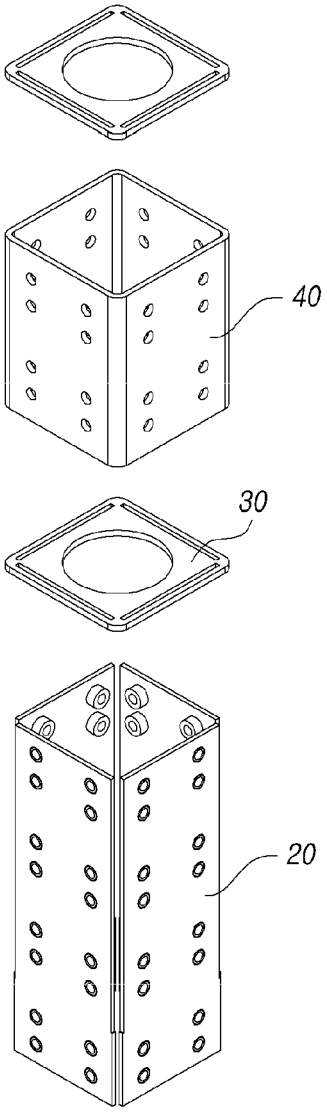
FIG. 3 is an exploded perspective view of the connecting core according to the first embodiment of the present disclosure.

FIG. 1 is an exploded perspective view showing the concept of combining a column and a beam using a connecting core according to a first embodiment of the present disclosure, FIG. 2 is a perspective view of a diaphragm, and FIG. 3 is an exploded perspective view of a connecting core.

In FIGS. 1 to 3, the connecting core 10 includes internal reinforcing members 20, a diaphragm 30, and an intermediate column 40.

The internal reinforcing members 20 are steel materials and are formed in a plate shape. In the first embodiment, the internal reinforcing members 20 are four pieces and are respectively coupled to the inner sides of the intermediate column 40 having a rectangular steel tube shape to be described below. Several holes for bolting are formed at the internal reinforcing members 20. Protrusions for bolting may also be formed at the internal reinforcing members 20.

The diaphragm 30, as shown in FIG. 2, is a rectangular plate-shaped steel material and having sides of 350 mm. A through-hole 32 is formed at the center of the diaphragm 30.

Further, slits 34 for inserting the internal reinforcing members 20 are formed at the diaphragm 30. The slits 34 are formed along four edges of the diaphragm 30 so that all of the four internal reinforcing members 20 can be inserted.

In the first embodiment, two diaphragms 30 are provided to be coupled to the upper portion and the lower portion of the intermediate column 40.

The intermediate column 40 is formed by cutting a rectangular steel tube. The internal reinforcing members 20 are coupled to the inner sides of the intermediate column 40. For this coupling, several bolt holes are formed at each of four sides of the intermediate column 40. The size of the bolt holes for bolts 90 is 24 mm.

The diaphragms 30 are coupled to the upper portion and the lower portion of the intermediate column 40.

In the drawings, external reinforcing members 50 are plates and are coupled to the outer side of the intermediate column 40. The original purpose of the connecting core 10 can be achieved even without the external reinforcing members 50, but rigidity can be further increased by coupling the external reinforcing members 50.

Several through-holes for inserting the bolts 90 are also formed at the external reinforcing members 50.

In FIG. 3, the connecting core 10 is assembled by combining first the internal reinforcing members 20 and the lower diaphragm 30, then combining the internal column 40, and finally combining the upper diaphragm 30.

Figure 4:
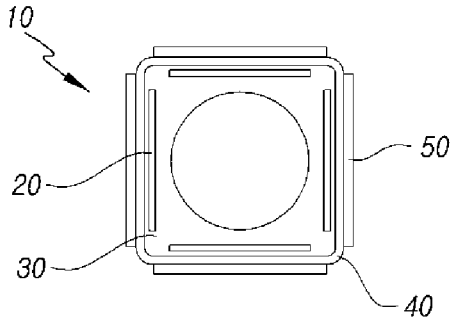
FIG. 4 is a plan view of the connecting core according to the first embodiment of the present disclosure.

FIG. 4 is a plan view of the connecting core according to the first embodiment of the present disclosure.

Bolts are not shown in FIG. 4 to help understanding. As shown in the figure, the internal reinforcing members 20 are inserted in the slits 34 of the diaphragms 30 and the diaphragms 30 are fitted in the intermediate column 40. The external reinforcing members 50 are attached to the outer side of the intermediate column 40.

Figure 5:
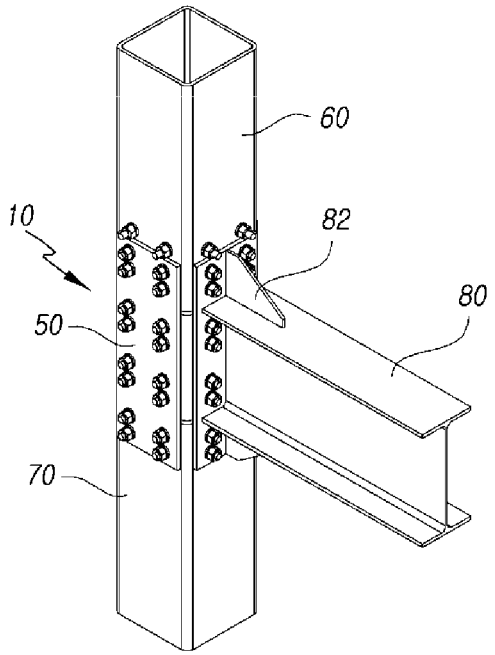
FIG. 5 is a perspective view showing a state in which a column, a beam, and a connecting core are combined in accordance with the first embodiment of the present disclosure.

FIG. 5 is a perspective view showing an assembly of a column, a beam, and the connecting core according to the first embodiment of the present disclosure.

As shown in the figure, the connecting core 10 is connected to an upper column 60 and a lower column 70 and is also combined with a beam 80, so an assembly of columns and a beam is achieved. The beam 80 connected to the connecting core 10 is an H-beam, but is not limited thereto. Further, stiffeners 82 are formed on the beam 80, thereby further increasing rigidity.

Figure 6:
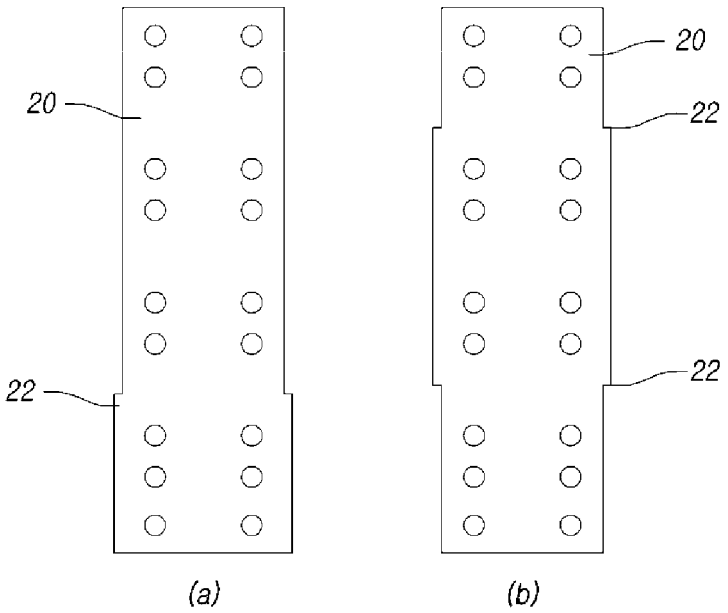
FIG. 6 is a front view showing an internal reinforcing member having a stopper in accordance with the first embodiment of the present disclosure.
Figure 7:
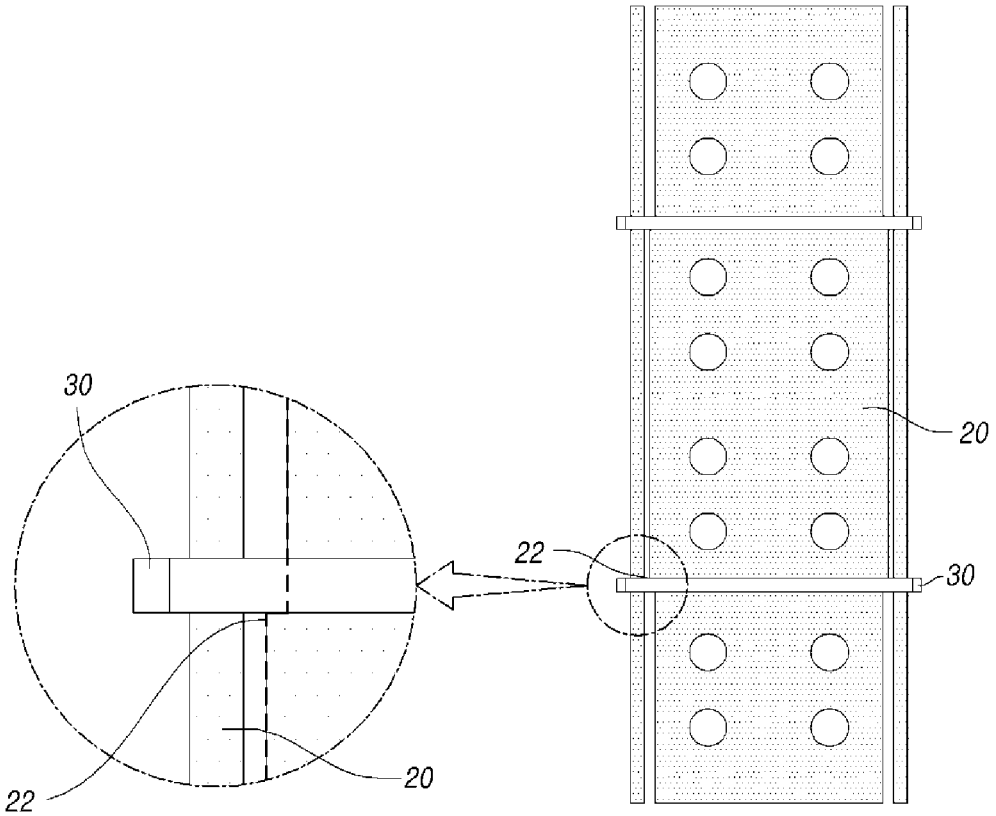
FIG. 7 is a front view and a partial enlarged view showing a state in which a diaphragm is coupled to the stopper of the internal reinforcing member shown in (a) of FIG. 6.

On the other hand, FIG. 6 is a front view and a partial enlarged view showing an internal reinforcing member having stoppers 22 in accordance with the first embodiment and FIG. 7 is a front view showing a state in which the diaphragms 30 are fitted to the stoppers of FIG. 6.

As shown in FIG. 6, a stopper 22 may be formed on the internal reinforcing member 20 to help determine the vertical position of a diaphragm 30 when the internal reinforcing member 20 is inserted through a slit 34 of the diaphragm 30. The stopper 22 is stepped a portion. That is, the stoppers 22 are formed by slightly increasing the width at a longitudinally predetermined position of the internal reinforcing member 20. The stopper 22 may be formed at one position, as shown in (a) of FIG. 6, and may be formed at two positions, as shown in (b) of FIG. 6.

FIG. 7 is a perspective view of a connecting core for a case in which a stopper is formed one position, as shown in (a) of FIG. 6. The diaphragm 30 is locked to the stopper 22 and cannot be moved any further, so the accurate coupling position can be secured.

Figure 8:
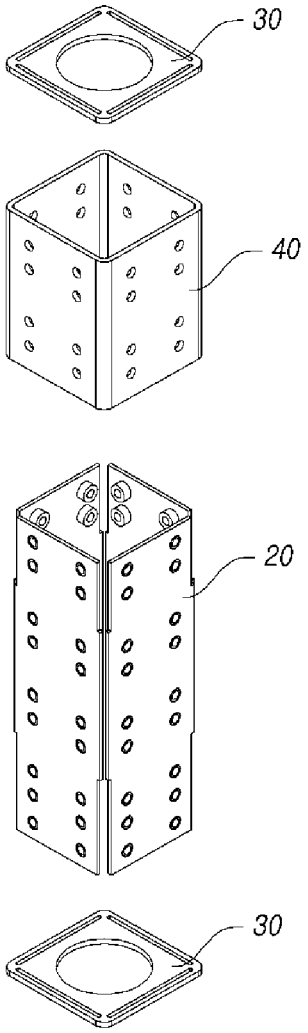
FIG. 8 is an exploded perspective view of a connecting core having two stoppers in the first embodiment of the present disclosure.
Figure 9:
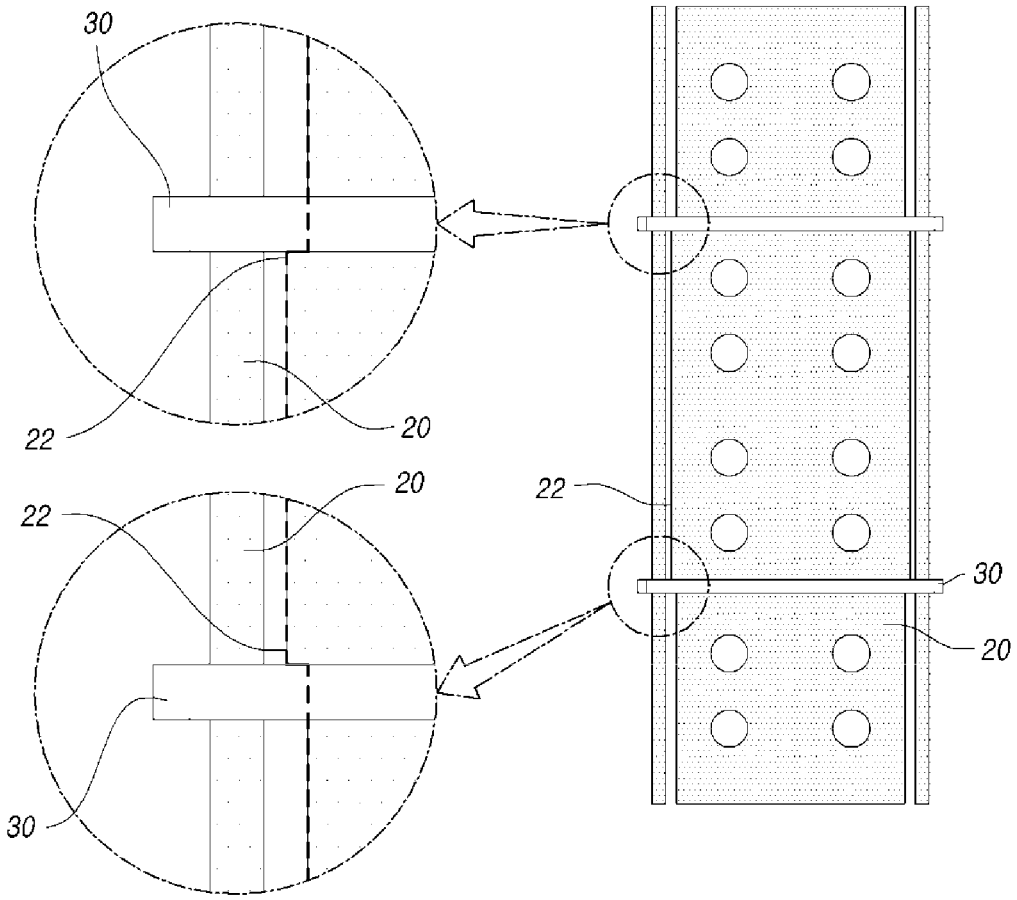
FIG. 9 is a front view and a partial enlarged view showing a state in which a diaphragm is coupled to the stopper of the internal reinforcing member shown in (b) of FIG. 6.

FIG. 8 is an exploded perspective view when stoppers are formed at two positions and FIG. 9 is a front view and a partial enlarged view showing a state in which diaphragms are fitted to stoppers of an internal reinforcing member in accordance with FIG. 8.

As shown in the figures, when stoppers 22 are formed at the upper portion and the lower portion of the internal reinforcing member 20, diaphragms 30 are fitted on the internal reinforcing member 20 from above and under and are locked to the stoppers 22, respectively, so they cannot be moved any further. Accordingly, the positions of the diaphragms 30 can be accurately set.

The order of assembling the connecting core 10 is changed when stoppers 22 are formed at the upper portion and the lower portion of an internal reinforcing member 20, as described above. That is, as shown in FIG. 8, a lower diaphragm 30 is fitted up to a lower stopper 22 of the internal reinforcing member 20, an intermediate column 40 is combined, and then an upper diaphragm 30 is fitted down to an upper stopper 22 of the internal reinforcing member 20.

Figure 10:
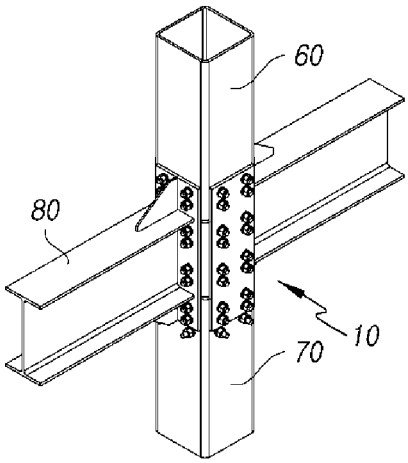
FIGS. 10 to 12 are perspective views showing several examples of a column and a beam combined by a connecting core in accordance with the first embodiment of the present disclosure.
Figure 11:
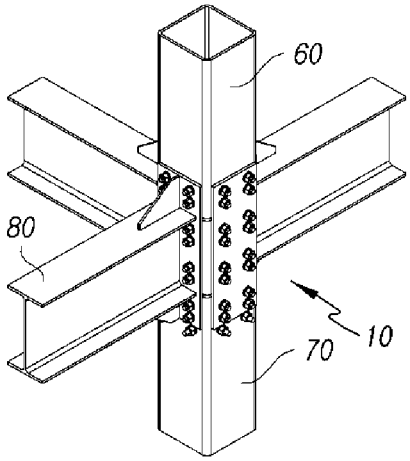
Figure 12:
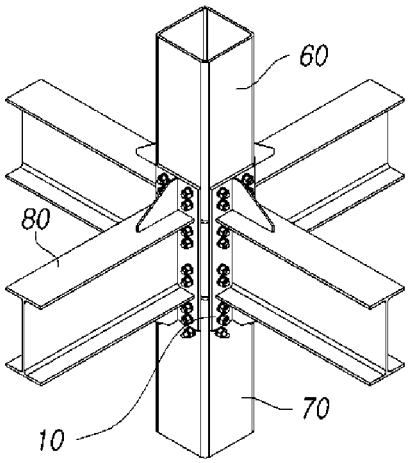

FIGS. 10 to 12 are perspective views showing various examples of columns and beams that are combined by a connecting core.

Figure 13:
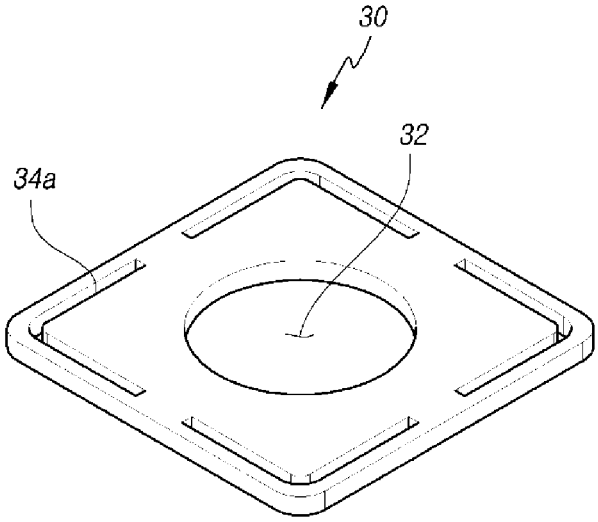
FIG. 13 is a perspective view of a diaphragm according to a second embodiment of the present disclosure.

Beams 80 that are combined with an intermediate column 40 are two pieces in FIG. 10, three pieces in FIG. 11, and four pieces in FIG. 13, but they are not limited to a specific number. That is, as shown in FIGS. 10 to 12, beams 80 can be coupled to two opposite sides, three sides, or four sides of an intermediate column 40.

The structure of a diaphragm and a connecting core can be variously changed in the present disclosure.

Figure 14:
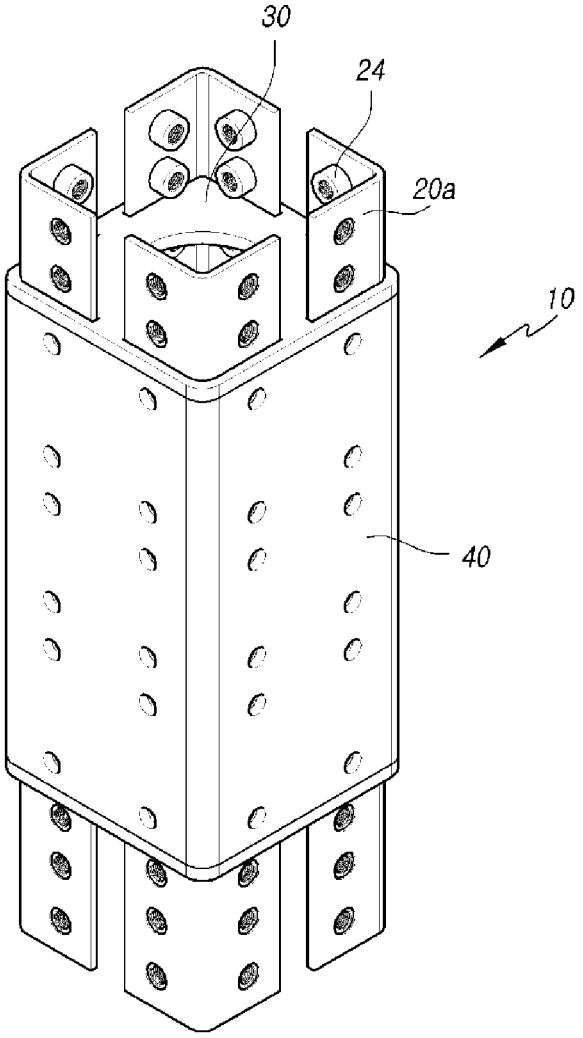
FIG. 14 is a perspective view of a connecting core according to the second embodiment of the present disclosure.
Figure 15:
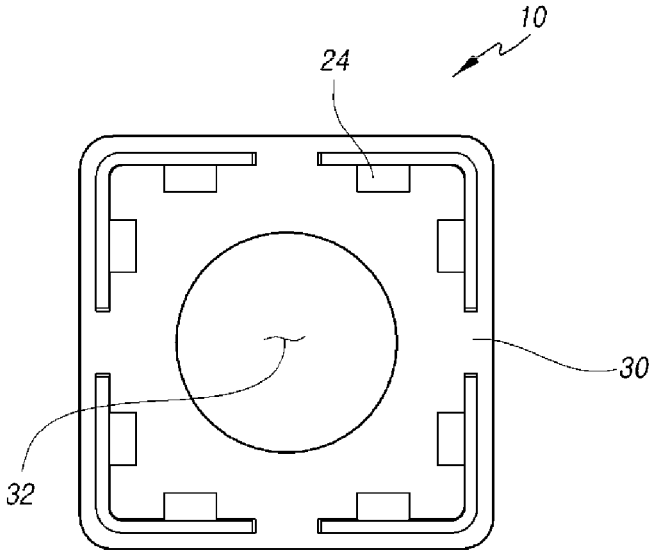
FIG. 15 is a plan view of the connecting core according to the second embodiment of the present disclosure.

FIG. 13 is a perspective view of a diaphragm according to an embodiment of the present disclosure and FIGS. 14 and 15 are a perspective view and a plan view of a connecting core according to the second embodiment.

As shown in FIG. 13, a diaphragm 30 is also a rectangular steel material in the second embodiment. A through-hole 32 is formed at the center of the diaphragm 30. However, slits 34*a* are each formed in an L-shape at four corners of the diaphragm 30.

In this case, an internal reinforcing member 20*a* is formed in an L-shape.

The diaphragms 30 are coupled to the upper portion and the lower portion of an intermediate column 40.

According to the second embodiment, diaphragms 30 and internal reinforcing members 20*a* are combined in L-shapes, as shown in FIGS. 14 and 15, whereby the fastening force can be further increased.

Figure 16:
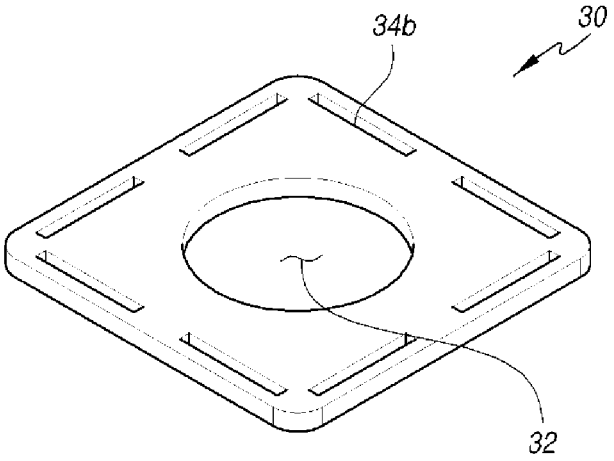
FIG. 16 is a perspective view of a diaphragm according to a third embodiment of the present disclosure.
Figure 17:
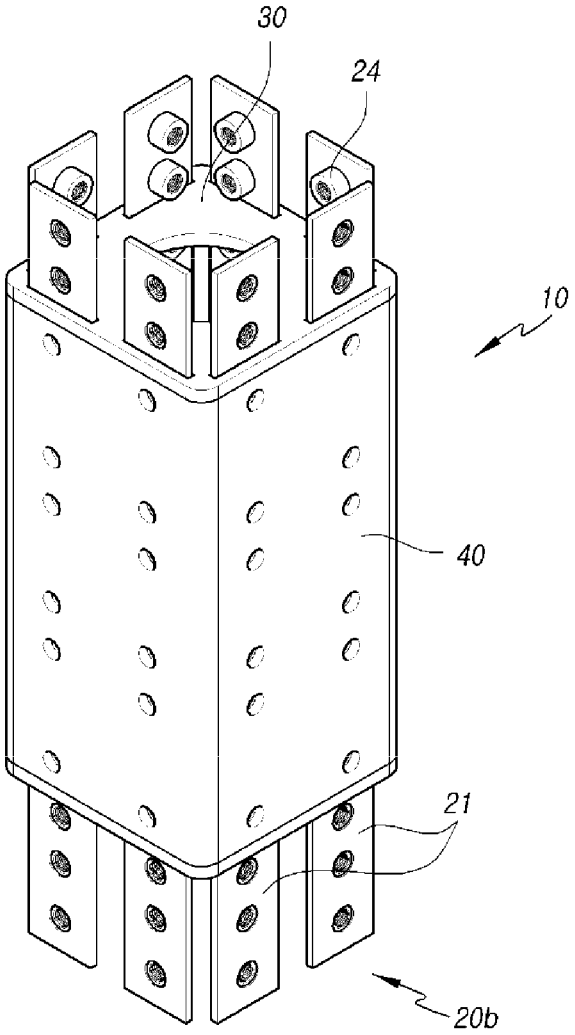
FIG. 17 is a perspective view of a connecting core according to the third embodiment of the present disclosure.
Figure 18:
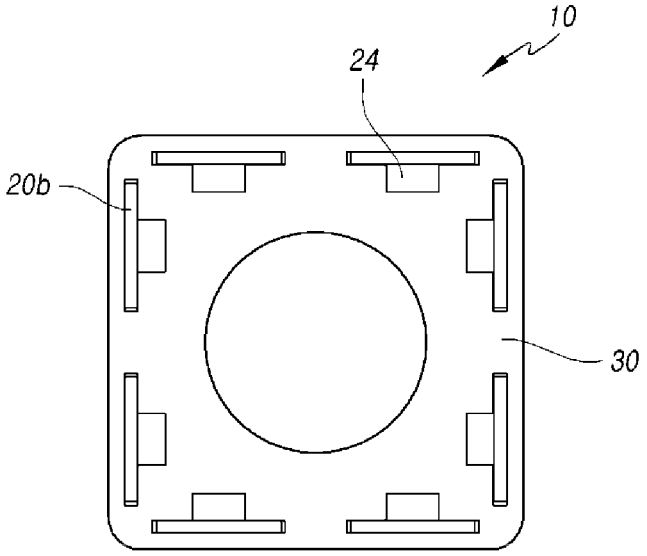
FIG. 18 is a plan view of the connecting core according to the third embodiment of the present disclosure.
Figure 19:
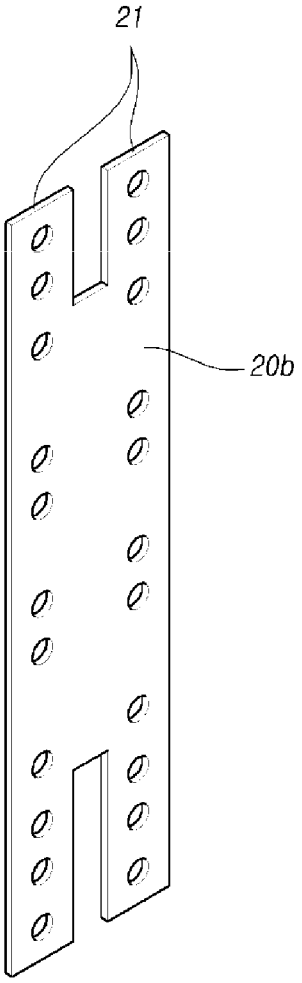
FIG. 19 is a perspective view of an internal reinforcing member that is used in the third embodiment of the present disclosure.

FIG. 16 is a perspective view of a diaphragm according to a third embodiment of the present disclosure, FIGS. 17 and 18 are a perspective view and a plan view of a connecting core according to a third embodiment, and FIG. 19 is a perspective view of an internal reinforcing member that is used in the third embodiment.

As shown in FIG. 16, a diaphragm 30 is also a rectangular steel material in the second embodiment. A through-hole 32 is formed at the center of the diaphragm 30. However, two slits 34*b* are formed along each side of the diaphragm 30.

In this embodiment, an internal reinforcing member 20*b* has two protrusions at each of the upper portion and the lower portion. Two protrusions 21 are fitted in two slits 34*b* formed along each side of the diaphragm 30.

According to the third embodiment, the diaphragm 30 and the internal reinforcing member 20*b* are coupled at two positions on each side, so the fastening force can be further increased.

The process of assembling a connecting core of the present disclosure described above is described for the first embodiment with reference to FIG. 1.

First, components of the connecting core 10, that is, the internal reinforcing members 20, the diaphragms 30, the intermediate column 40, and the external reinforcing members 50 are manufactured in a factory.

In detail, the connecting core 10 can be manufactured through a simple assembly process, unlike welding used in the related art. That is, the connecting core 10 can be assembled like assembly toy blocks such as Lego.

First, four internal reinforcing members 20 are inserted through the slits 34 of the lower diaphragm 30. The position where the lower diaphragm 30 is fixed can be accurately determined by the stoppers 22 of the internal reinforcing members 20.

Next, the intermediate column 40 is combined with the lower diaphragm 30 combined with the internal reinforcing members 20.

Next, the upper diaphragm 30 is fitted on the four internal reinforcing members 20.

The connecting core 10 formed in this way is temporarily assembled with a lower column 70 that is a rectangular steel tube and combined with the external reinforcing members 50 in a factory and is then sent to a site.

Figure 20:
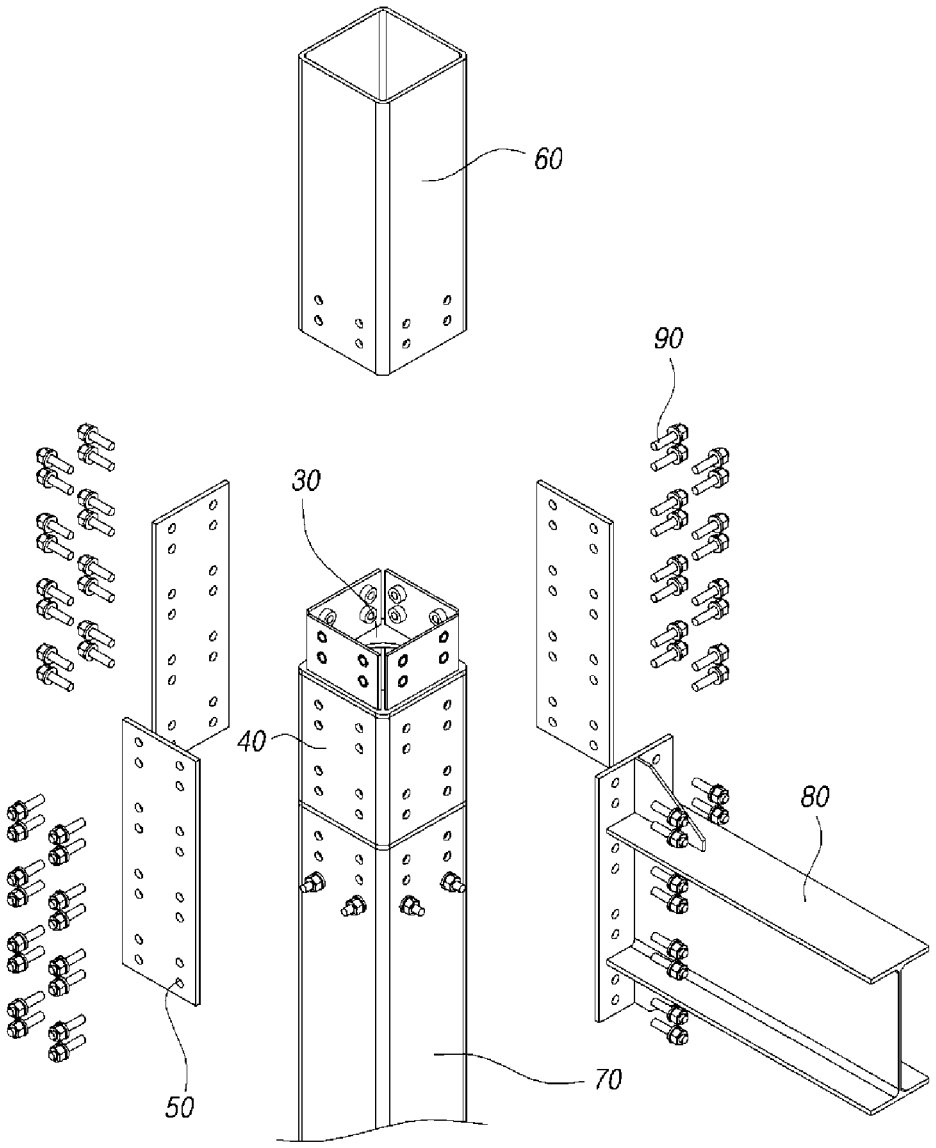
FIG. 20 is an exploded perspective view showing the concept of combining a column and a beam using a connecting core in accordance with the present disclosure.

Alternatively, a connecting core may be assembled in the way shown in FIG. 20.

That is, it may be possible to send only the connecting core 10 to a site and the temporarily combined the connecting core 10 with the lower column 70.

After the connecting core 10 and a column are combined, as described above, a beam 80 is combined.

The parts are fastened to each other by bolting. Bolts 90 may fasten all of the internal reinforcing members 20, the intermediate column 40, and the external reinforcing members 50 or some bolts may fasten only the internal reinforcing members 20 and the lower column 70.

As the bolts, common bolts are shown in FIG. 1, but it is preferable to use one-way bolts that are tightened in only one direction from the outside, but they can provide sufficient fastening force.

Figure 21:
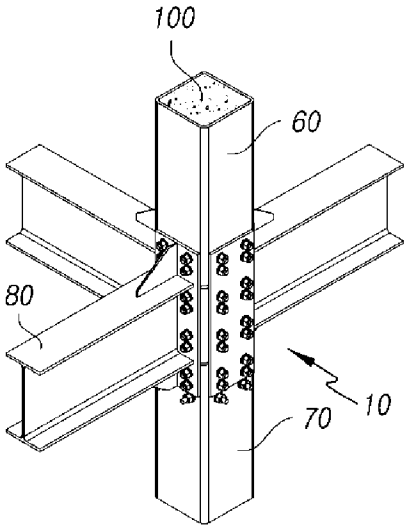
FIG. 21 is a view showing a state in which concrete has been poured after columns and beams are combined by a connecting core of the present disclosure.
Figure 21:
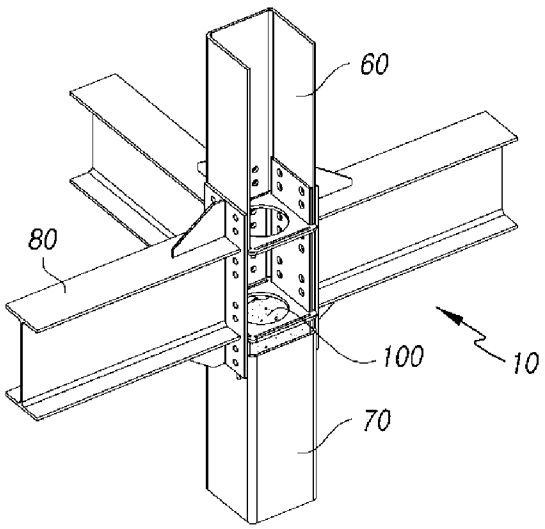

FIG. 21 is a view showing a state in which concrete has been poured after columns and beams are combined by the connecting core of FIG. 1 in an embodiment of the present disclosure.

When concrete 100 is poured in a closed-section steel tube, better structural performance can be achieved by adhesive force between the concrete 100 and the bolts 90. Further, there is no need for a process that uses a mold to pour concrete into a closed-section steel tube, so the construction period can be shortened.

Although the present disclosure has been described above in conjunction with particular embodiments, it will be apparent to those skilled in the art that the present disclosure is not limited to the above embodiments and various modifications and changes may be made without departing from the spirit and scope of the present disclosure. Therefore, these modifications and changes are intended to fall within the scope of protection of the present disclosure.

The invention claimed is:

1. A connecting core for column-beam joint, the connecting core comprising:

a closed-section intermediate column configured to be connected to a column and a beam;

a diaphragm positioned within a hollow interior of the intermediate column, the diaphragm having slits extending therethough that are disposed on a peripheral region of the diaphragm; and internal reinforcing members positioned in the slits disposed on the peripheral region of the diaphragm, and the internal reinforcing members positioned in the diaphragm are combined with the intermediate column.

2. The connecting core of claim 1, further comprising external reinforcing members that are coupled to an outer side of the intermediate column.

3. The connecting core of claim 1, wherein a stopper for stopping movement of the diaphragm is formed at each of the internal reinforcing members.

4. The connecting core of claim 1, wherein the internal reinforcing members and the external reinforcing members are bolted to the intermediate column.

5. The connecting core of claim 1, wherein stiffeners are formed at an end, which faces external reinforcing members, of the beam.

6. The connecting core of claim 1, wherein the slits are formed along sides of the diaphragm.

7. The connecting core of claim 6, wherein the internal reinforcing members are fitted in the slits of the diaphragm.

8. The connecting core of claim 1, wherein the slits are each formed in an L-shape at corners of the diaphragm.

9. The connecting core of claim 8, wherein the internal reinforcing members are each formed in an L-shape and are fitted in the slits of the diaphragm.

10. The connecting core of claim 1, wherein two slits are formed along each side of the diaphragm.

11. The connecting core of claim 10, wherein the internal reinforcing members each have two protrusions at each of an upper portion and a lower portion such that two protrusions are fitted in two slits.

12. A method of connecting a column and a beam using the connecting core of claim 1, the method comprising:

forming the connecting core by assembling the internal reinforcing members, the diaphragm, the intermediate column, and external reinforcing members;

coupling a closed-section lower column to the connecting core;

carrying an assembly of the connecting core and the lower column and then combining a first beam with the assembly;

coupling an upper column to the connecting core; and coupling a second beam to the connecting core, wherein the columns and the beams are capable of being connected without welding.

13. The method of claim 12, wherein floors are constructed one by one by connecting the lower column, the upper column, and the beams at one point using the connecting core.

14. The method of claim 12, further comprising pouring concrete into the upper column, the lower column, and the intermediate column after the coupling of the beams to the connecting core.

* * * * *